US006394304B1

(12) United States Patent
Bohne et al.

(10) Patent No.: US 6,394,304 B1
(45) Date of Patent: May 28, 2002

(54) PAINT CAN HOLDER

(76) Inventors: Catherine Judy Bohne, 5710 Chemin de Vie, Atlanta, GA (US) 30342; Cynthia Susan Beard, 200 Colonial Homes Dr., #404, Atlanta, GA (US) 30309

( * ) Notice: Subject to any disclaimer, the term of this patent is extended or adjusted under 35 U.S.C. 154(b) by 45 days.

(21) Appl. No.: 09/597,546

(22) Filed: Jun. 19, 2000

Related U.S. Application Data

(60) Provisional application No. 60/142,922, filed on Jul. 9, 1999.

(51) Int. Cl.[7] ..... B65D 25/28

(52) U.S. Cl. ..... 220/737; 220/741; 248/145.6; 294/31.2; 294/32

(58) Field of Search ..... 220/737–743, 220/676; 248/102, 105, 676, 145.6; 215/395; 294/31.2, 32; D7/622

(56) References Cited

U.S. PATENT DOCUMENTS

| | | | | | |
|---|---|---|---|---|---|
| 395,409 | A | * | 1/1889 | Waters | 248/145.6 |
| 592,012 | A | * | 10/1897 | Lewis | 220/741 |
| D34,621 | S | * | 6/1901 | McLaughlin | 215/395 |
| D38,208 | S | * | 8/1906 | Helmer | 215/395 |
| 927,521 | A | * | 7/1909 | Geig | 220/485 |
| 1,528,713 | A | * | 3/1925 | Weirick | 220/737 |
| 1,702,555 | A | * | 2/1929 | Watson | 215/395 |
| 1,782,962 | A | * | 11/1930 | Hobbs | 220/742 |
| 2,122,628 | A | | 7/1938 | Tracy | 65/61 |
| D154,588 | S | * | 7/1949 | Collins | 215/395 |
| 2,518,214 | A | | 8/1950 | Worthington | 15/140.2 |
| 2,626,737 | A | | 1/1953 | Pitz | 224/48 |
| 2,709,540 | A | | 5/1955 | Kenney | 222/126 |
| 2,774,510 | A | * | 12/1956 | Logan | 220/696 |
| 2,961,112 | A | * | 11/1960 | Didion | 215/395 |
| 3,261,635 | A | * | 7/1966 | Talay | 220/737 |
| 4,045,069 | A | | 8/1977 | Fife | 294/31.2 |
| 4,715,633 | A | | 12/1987 | Brink et al. | 294/27.1 |
| 5,492,246 | A | | 2/1996 | Bailey | 220/756 |
| 5,511,753 | A | | 4/1996 | Lage | 248/238 |
| 5,549,216 | A | | 8/1996 | Scholl | 220/695 |
| 5,921,431 | A | * | 7/1999 | Pych | 220/668 |

FOREIGN PATENT DOCUMENTS

| | | |
|---|---|---|
| GB | 181980 | 6/1922 |
| GB | 2231857 | 11/1980 |

* cited by examiner

*Primary Examiner*—Lee Young
*Assistant Examiner*—Joseph C. Merek
(74) *Attorney, Agent, or Firm*—Richard C. Litman

(57) ABSTRACT

A paint can holder used for holding a partially filled can of paint used for trimming out walls and ceilings. The holder has a cylindrical body and an ergonomic handle. The lateral wall of the holder comprises a plurality of vertical columns. The holder can be fabricated using a minimal amount of material. The holder is strategically reinforced so that the holder is lightweight yet very strong.

4 Claims, 3 Drawing Sheets

PAINT CAN HOLDER

CROSS-REFERENCE TO RELATED APPLICATION

This application claims the benefit of U.S. Provisional Patent Application Serial No. 60/142,922, filed Jul. 9, 1999.

BACKGROUND OF THE INVENTION

1. Field of the Invention

The present invention relates generally to container holders and more particularly, to a holder for paint cans.

2. Description of the Related Art

Putting the finishing touches on a paint job is important because it has a great deal to do with the quality and appearance of the finished work. However, putting the finishing touches on a paint job can be cumbersome because trimming out walls and ceilings require that the painter carry the paint can around as the paint is applied. Although only a partially full can of paint is needed for trimming, supporting and handling the paint can as the painter trims is awkward. Paint manufacturers provide a thin piece of wire that is tied around the paint can to support the can. A painter must then hold the paint can with the palm, fingers and thumb wrapped around the wire, as the painter attempts to trim a wall or ceiling without spilling paint. This is a tenuous solution because the looped wire can cause injury to the thumb and holding the paint can with the palm and fingers of the hand is uncomfortable, inconvenient, and fatiguing.

The prior art describes a number of container holders that are used to hold a variety of containers. A container holder is described in U.S. Pat. No. 2,122,628 issued on Jul. 5, 1938 to A. H. Tracy. The holder is constructed and arranged to removably engage and support a beverage can such as a standard beer can. The can and holder are used in the same manner as a mug or stein and beverage is drank directly from the can. U.S. Pat. No. 2,518,214 issued on Aug. 8, 1950 to M. L. Worthington describes a holder for paint cans. The holder has a supporting base that is adapted to receive and support different sized paint cans. The area of the supporting base is larger in area than the bottom of the largest can to be supported. The base has an annular well which surrounds the supported paint can and receives any overflow or spillage of paint and prevents any paint from getting onto the supporting surface portion of the base.

U.S. Pat. No. 2,626,737 issued on Jan. 27, 1953 to A. G. Pitz describes a combined paint can holder and brush support. The combined paint can holder and brush support consists of a pie-plate shaped base that includes an upturned edge, an abutment that is near the upturned edge and firmly attached to the base and that has an arcuate surface adapted to conform to a paint can, and a handle that has one end fixed to the edge and the other end firmly attached to the abutment. A paint can holder is described in U.S. Pat. No. 2,709,540 issued on May 31, 1955 to J. T. Kenny. The paint can holder has a handle and an adjustable funnel that can be moved up and down so that it will fit any size can carried by the holder.

A paint bucket holder is described in U.S. Pat. No. 4,045,069 issued on Aug. 30, 1977 to C. L. Fife. The paint bucket holder consists of an upper strap secured by a buckle around a paint bucket and a lower strap secured around a paint bucket that are connected by a pair of vertical straps to which a wooden handle is attached and just below the wooden handle a metal handle is attached. U.S. Pat. No. 4,715,633 issued on Dec. 29, 1987 to D. F. Brinks et al describes a cup holder for holding a disposable cup. The cup holder includes a member for gripping the outer surface of the cup and a mechanism for adjusting the gripping member to conform to the diameter of the cup. The cup holder also has a handle and a mechanism for attaching the handle to the gripping member.

A cup holder with counter assembly is described in U.S. Pat. No. 5,492,246 issued on Feb. 20, 1996 to F. N. Bailey. The cup holder has a tubular body with an open top end for removably receiving a drinking cup and a C-shaped handle that extends from the rear end of the tubular body. The cup holder has a structure for counting the number of glasses of water drunk daily. The counter assembly has a disc and numbers from 0–10 that are spaced around the perimeter of its front face. The counter assembly is mounted in the top end of the handle. U.S. Pat. No. 5,511,753 issued on Apr. 30, 1996 to R. R. Lage describes a paint can holder that is mountable on a ladder for suspending a paint can with the mouth of the can open.

A paint holder and delivery device is described in U.S. Pat. No. 5,549,216 issued on Aug. 27, 1996 to R. Scholl. The paint holder and delivery device consists of a container with a disposable insert that fits within the container to facilitate the application of paint with a paintbrush. UK Patent No. 181,980 published in June, 1922 describes a method for securing handles to cans and pails. UK Patent No. 2,231,857 published in November, 1990 describes an apparatus for holding a paint tin and a paintbrush.

The paint can holder of the present invention solves the aforementioned problems by providing a paint can holder that is strong, durable, lightweight, and easy to use. None of the above inventions and patents, taken either singly or in combination, is seen to describe the instant invention as claimed.

SUMMARY OF THE INVENTION

The invention is a cylindrical paint can holder that has an ergonomic handle. The paint can holder is made of a strong, durable plastic. Specific locations of the paint can holder are reinforced to ensure the structural integrity and to increase the weight-bearing capacity of the holder. The holder comes in two different sizes. One size of the holder will accommodate a one gallon paint can and the other size of the holder will accommodate a quart paint can.

The paint can holder of the present invention makes carrying a paint can much easier and much more comfortable over long periods of time. The holder is specifically designed to hold a partially filled paint can that is used for trimming out walls and ceilings. The paint can holder of the present invention is very economical because its manufacture requires a minimal amount of material, yet the holder is strong and durable.

Accordingly, it is a principal object of the invention to provide a paint can holder that is strong, durable, and lightweight.

It is another object of the invention to a paint can holder that is convenient and easy to use.

It is a further object of the invention to provide a paint can holder that is comfortable to grip.

Still another object of the invention is to provide a paint can holder that makes trimming out a wall or ceiling easy.

It is an object of the invention to provide improved elements and arrangements thereof in a paint can holder for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
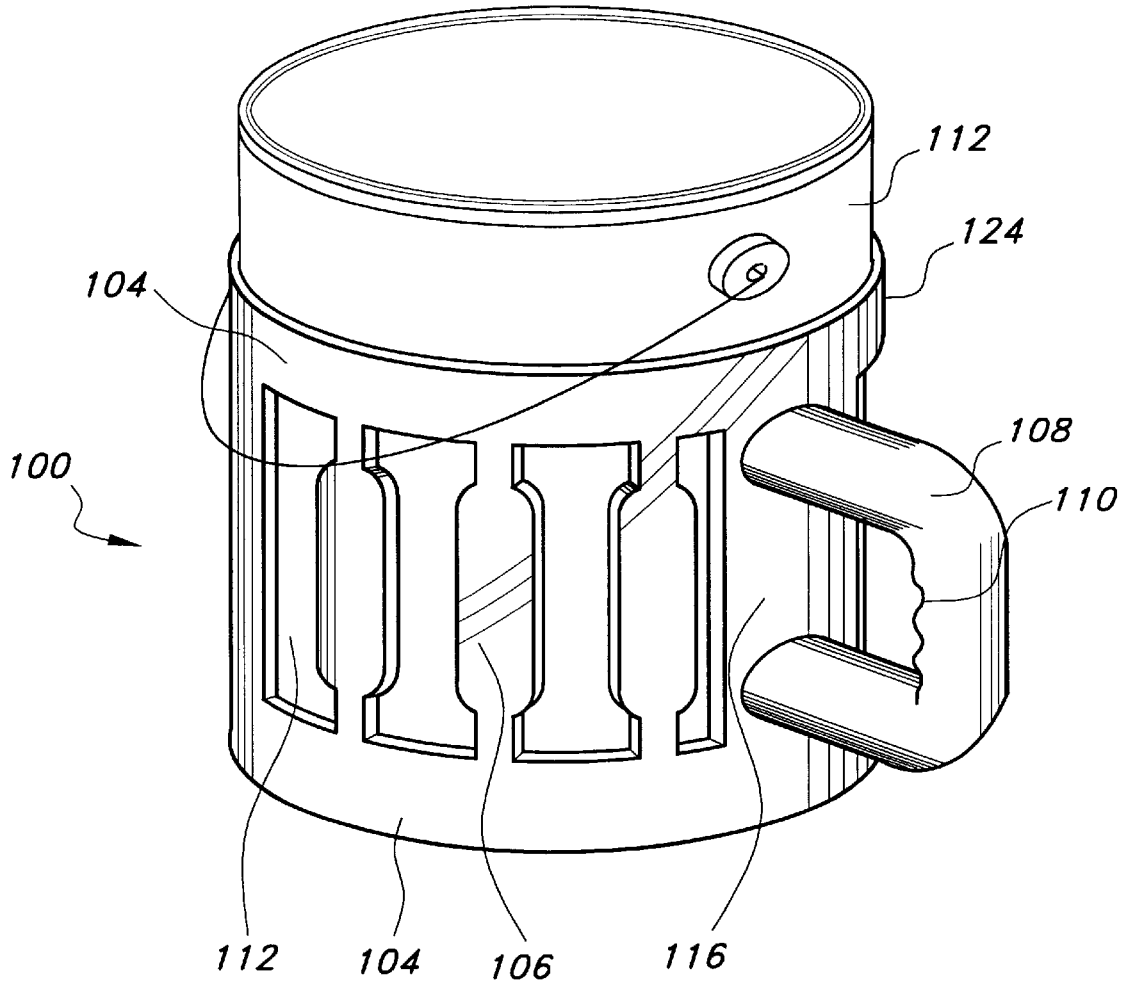
FIG. 1 is an environmental, perspective view of the paint can holder holding a can of paint according to the present invention.

FIG. 1 is an environmental, perspective view of the paint can holder 100 holding a can of paint 112. The cylindrical body 124 of the holder 100 is not solid but comprises a plurality of vertical columns (106, 114, 116) attached to an upper circular piece 102 and a lower circular piece 104. The front vertical column 114 and the rear vertical column 116 are not contoured while the lateral vertical columns 106 are contoured. The front and rear vertical columns 114, 116 are wider and thicker than the lateral vertical columns 106. The paint can holder 100 of the present invention is designed to easily support the weight of a half or partially filled paint can 112 that is used for trimming out walls and ceilings.

The paint can holder 100 is strong but lightweight. To minimize the weight of the holder 100, a minimal amount of material is used to fabricate the body 124 of the holder 100. This minimizing of the weight of the body 124 is accomplished by creating the lateral wall of the body 124 from a plurality of vertical columns (106, 114, 116) instead using a single solid piece of material. A further weight reduction is achieved by contouring the vertical columns (106, 114, 116). By reinforcing the holder 100 at strategic locations, a lightweight yet very strong paint can holder 100 is produced.

In a preferred embodiment, the paint can holder 100 of the present invention is made of a strong, durable plastic, however, any suitable material with the appropriate properties could be used. The upper circular piece 102, the lower circular piece 104, the front vertical column 114, and the rear vertical column 116 are thicker than the lateral vertical columns 106 because they provide the structural integrity of the holder 100. A sturdy but comfortable ergonomic handle 108 is attached to the rear vertical column 116. The handle 108 has medially disposed indentations 110 for the fingers for added comfort.

Figure 2:
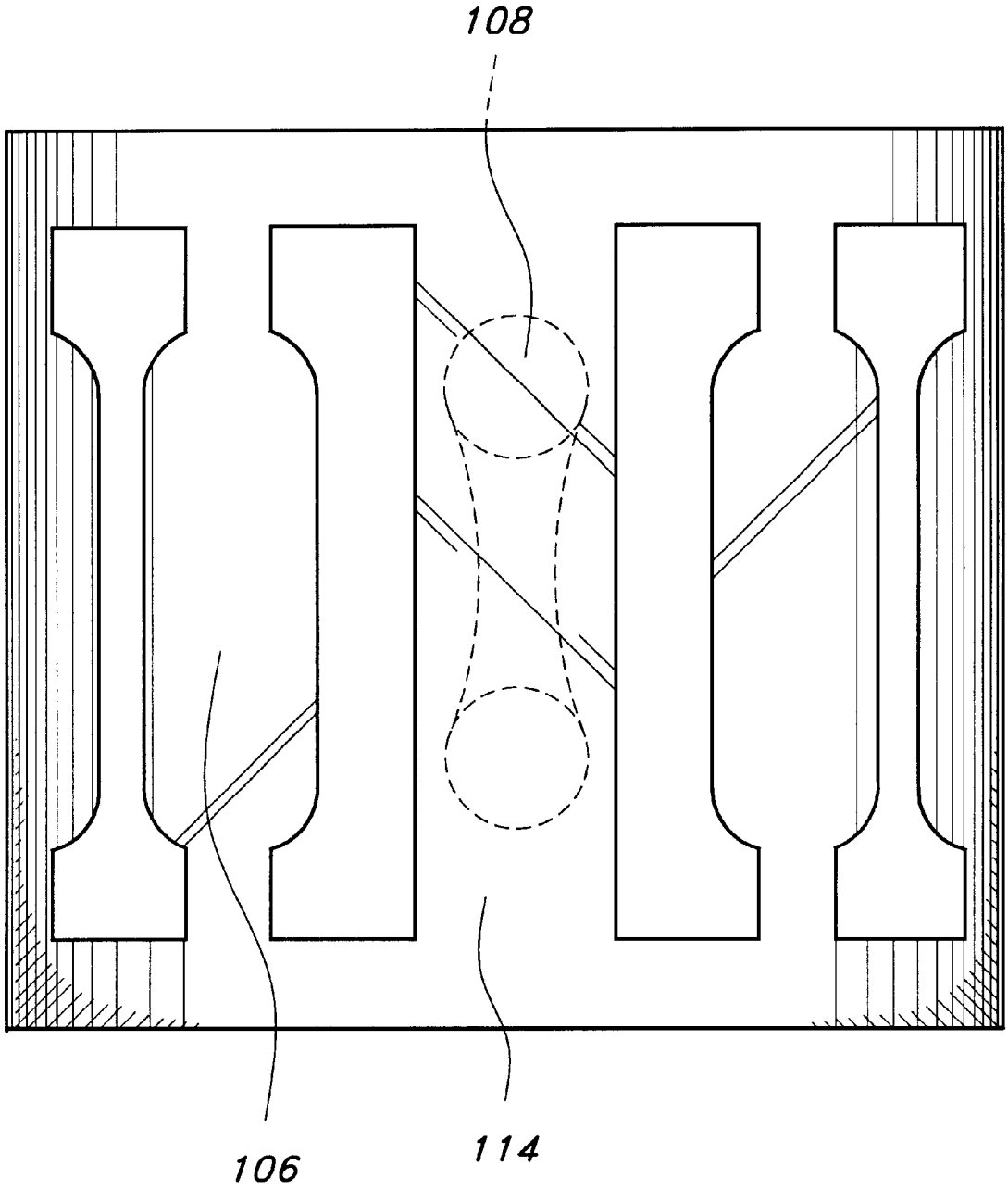
FIG. 2 is a front view of a paint can holder according to the present invention.
Figure 3:
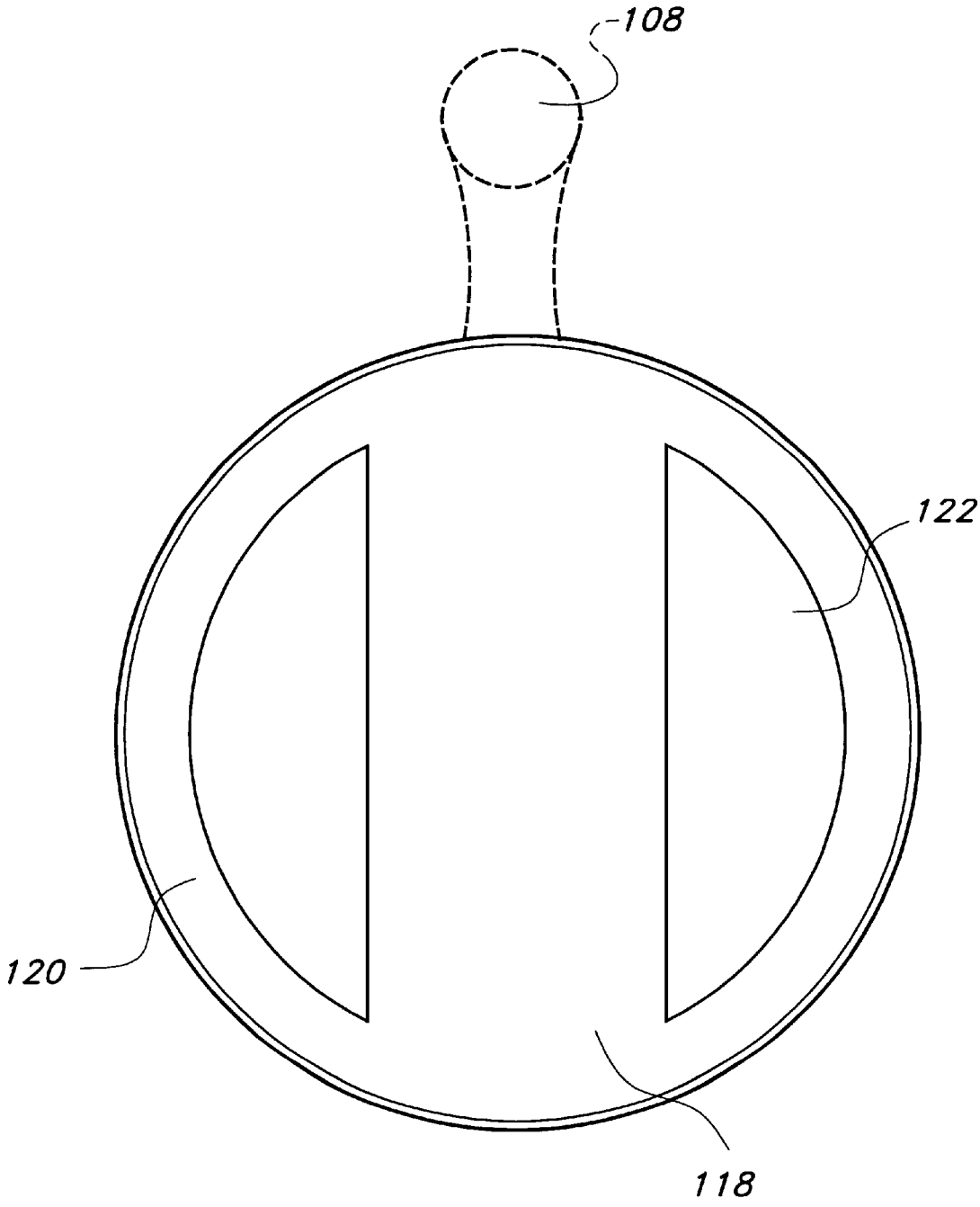
FIG. 3 is a bottom view of a paint can holder according to the present invention.

FIG. 2 is a front view of the paint can holder 100 showing the noncontoured front vertical column 114 and the adjacent contoured vertical columns 106. The middle portion of a contoured vertical column 106 is wider for increased structural support. FIG. 3 is a bottom view of the paint can holder 100 showing that the bottom (118, 120) of the holder 100 is not a single solid piece but instead is configured and comprises a centrally disposed piece 118 attached to a circular rim 120. Removing a portion of the holder's bottom (118, 120) reduces the overall weight of the holder 100, however, both the center piece 118 and the circular rim 120 are sufficiently wide and thick enough to easily support the weight of a partially filled paint can 112. Even with the two openings 122 in the bottom (118, 120) of the holder 100, there is more than sufficient surface area available to provide the necessary structural support.

The paint can holder of the present invention eliminates the burden on a painter of having to lug around a paint can while trimming out a wall or ceiling. Even though the paint can is only partially filled, it is still very troublesome and worrisome to directly hold the paint can as a painter works because the probability of an accidental spill and the mess that results is always high.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated.

It is to be understood that the present invention is not limited to the embodiments described above, but encompasses any and all embodiments within the scope of the following claims.

We claim:

1. A paint can holder comprising:

a cylindrical body made up of an upper circular portion, a lower circular portion, a plurality of vertical columns, and a configured bottom, said plurality of vertical columns including a noncontoured front vertical column, a noncontoured rear vertical column, and contoured lateral vertical columns dispersed between said front and rear columns, said contoured columns having a variable width, each of said front vertical column and said rear vertical column are wider than each of said lateral vertical columns, and said configured bottom comprises a centrally disposed portion and a circular rim; and an ergonomic handle extending from either of said front vertical column or said rear vertical column with medially disposed finger indentations.

2. The paint can holder according to claim 1, wherein said cylindrical body and said handle are made of plastic.

3. In combination, a paint can and a paint can holder, said paint can holder comprising a cylindrical body made up of an upper circular portion, a lower circular portion, a plurality of vertical columns, and a configured bottom, said plurality of vertical columns including a noncontoured front vertical column, a noncontoured rear vertical column, and contoured lateral vertical columns dispersed between said front and rear columns, said contoured columns having a variable width, each of said front vertical column and said rear vertical column are wider than each of said lateral vertical columns, and said configured bottom comprises a centrally disposed portion and a circular rim, and an ergonomic handle extending from either of said front vertical column or said rear vertical column with medially disposed finger indentations, wherein said paint can may be placed inside of said cylindrical body.

4. The combination according to claim 3, wherein said cylindrical body and said handle are made of plastic.

* * * * *